United States Patent [19]

Gattu et al.

[11] 4,386,711

[45] Jun. 7, 1983

[54] CRANE HAVING STABILIZER OUTRIGGERS AND VERTICALLY POSITIONABLE JACKS FOR SAME

[75] Inventors: Narahari Gattu; Joseph C. Terranova, III, both of Cedar Rapids, Iowa

[73] Assignee: Harnischfeger Corporation, West Milwaukee, Wis.

[21] Appl. No.: 203,943

[22] Filed: Nov. 7, 1980

[51] Int. Cl.[3] ..... B66C 15/00

[52] U.S. Cl. ..... 212/189; 254/423

[58] Field of Search ..... 212/189; 254/86 R, 103; 280/766

[56] References Cited

U.S. PATENT DOCUMENTS

| | | | |
|---|---|---|---|
| 1,359,849 | 11/1920 | Thompson | 254/103 |
| 2,777,586 | 1/1957 | Boysen et al. | 212/189 |
| 3,062,386 | 11/1962 | Johnson | 212/189 |
| 3,105,675 | 10/1963 | Blackburn | 254/103 |
| 3,442,531 | 5/1969 | Rutledge | 254/86 R |
| 3,888,464 | 6/1975 | Felsen | 254/86 R |
| 4,118,054 | 10/1978 | Vigerie | 212/189 |

*Primary Examiner*—Trygve M. Blix
*Assistant Examiner*—Stephen P. Avila
*Attorney, Agent, or Firm*—James E. Nilles

[57] ABSTRACT

A crane having outriggers that can be extended transversely of the main frame of the crane, and a vertically positionable jack is located at the outer ends of the outriggers and include a vertical, threaded shaft having a ground engaging pad at its lower end and which is non-rotatably carried by the outer end of the beam. A power drive is located within the beam for rotating a large nut that is engaged by the shaft and which is carried by the interior portion of the beam. This power drive includes a hydraulic motor which drives a speed reducer which in turn furnishes power to the sprocket and endless chain connection between the speed reducer and threadably driven nut.

1 Claim, 6 Drawing Figures

CRANE HAVING STABILIZER OUTRIGGERS AND VERTICALLY POSITIONABLE JACKS FOR SAME

BACKGROUND OF THE INVENTION

Various types of vertically positionable jacks have been provided for outriggers of cranes for stabilizing thereof. These prior art devices included hydraulically actuated jacks, worm and pinion actuated jacks and other means for either manually or with power vertically positioning the jacks. Examples of vertically positionable, outriggers having a threaded vertical member which is positionable by pinion and gear means are shown in the U.S. Pat. Nos. 3,790,133 issued Feb. 5, 1974; 3,888,464 issued June 10, 1975; and 3,3035,713 issued May 22, 1962. Such prior art devices however are subject to malfunction due to the close tolerances required between the parts and the relative unintended movement between the parts when heavy loads are imposed on the jack resulting in binding or other difficulties in operating the unit.

Another example of a prior art device of the hydraulic type is shown in the U.S. Pat. No. 3,677,417 of July 18, 1972 which is rather complicated and costly, requires fluid lines and sources and other components, such as pumps, hoses and reservoirs. All of these prior art devices also extend considerably above the outriggers to form protrusions which are also damaged by the swinging load or otherwise in the way of workmen in the area.

SUMMARY OF THE INVENTION

The present invention provides a vertically positionable power operated, stabilizing jack for a crane, more specifically the jack includes a vertically disposed threaded shaft which is fixed against rotation but is driven in a vertical direction. A large internally threaded nut is fixed within the outer end of the outrigger and in engagement with the vertical shaft so that rotation of the nut in either direction causes vertical movement of the shaft. Means are provided for rotating the nut and this means takes the form of a hydraulic motor and gear reducer which in turn is connected to the nut by sprockets and an endless roller chain around the sprocket, one of the sprockets being secured to the gear reducer while the other is secured to the large nut.

The entire drive assembly for the jack is located within the confines of the outrigger and is compact and out-of-the-way and particularly efficient and free of malfunctioning even though it is subjected to considerable loading in various directions.

These and other objects and advantages of the present invention will appear hereinafter as this disclosure progresses, reference being had to the accompanying drawings.

DESCRIPTION OF A PREFERRED EMBODIMENT

GENERAL ORGANIZATION

Figure 1:
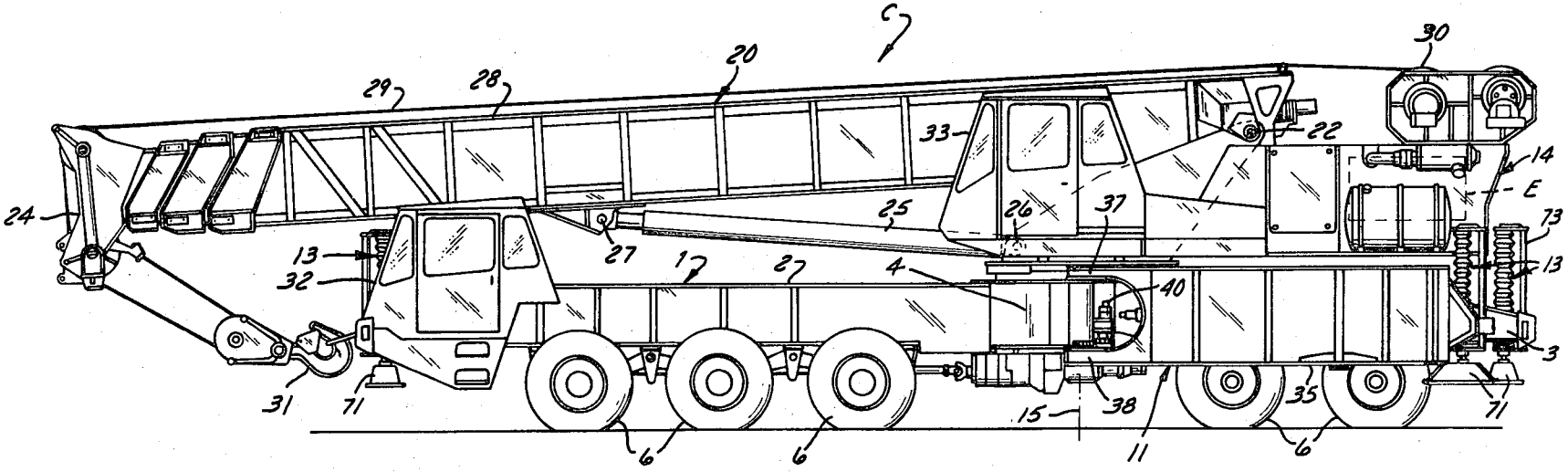
FIG. 1 is an elevational view taken from the left side of a truck crane and showing the extensible outriggers swung to the stowed position along the main frame.
Figure 2:
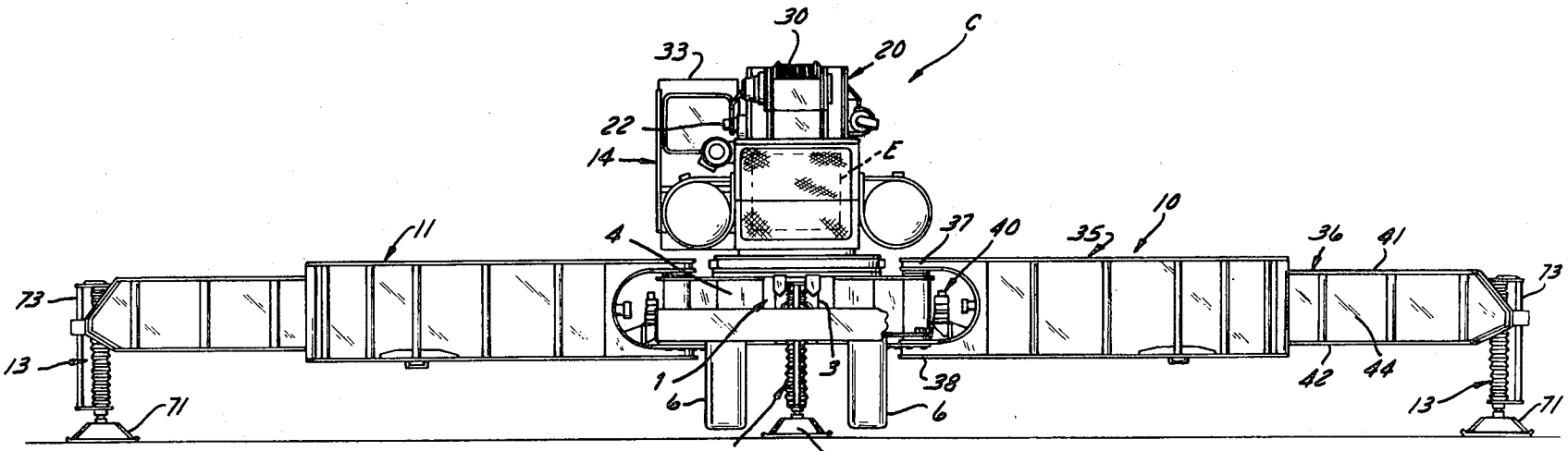
FIG. 2 is a rear view of the crane shown in FIG. 1, but with the outriggers swung away from the main frame and extended with all four jacks in the ground engaging position.

The general organization of a self-propelled truck crane C shown for the purpose of illustrating the present invention is shown in FIGS. 1 and 2 and includes an elongated main frame 1 comprising a tubular front portion 2 and a tubular rear portion 3 which are both of rectangular transverse cross section and fabricated from steel plates that are welded together. The main frame also includes an intervening tub 4 to which adjacent ends of the front and rear portions are welded to form a unitary main frame. Ground engaging wheels 6 are located and attached by suspension means to the lower portion of the main frame to permit the crane to be transported to and from the job site over the highway or other terrain.

A pair of transversely extendible outriggers 10 and 11 are extendible from each side of the main frame and are pivotably connected to their respective sides of the tub of the main frame. These outriggers are swingable from the transport position shown in FIG. 1 where they are located in a stowed position generally parallel with and alongside the main frame and any one of a number of transversely extending positions outwardly of the main frame for stabilizing the truck crane when the boom is in operation. A vertically extendible ground engaging jack 13 is located at each of the forward and rearward ends of the main frame and also at each of outer ends of the two outriggers, providing four widely spaced apart jacks for stabilizing the crane against tipping when the boom is in the working position. These jacks can be power operated from a raised position shown in FIG. 1 for transport of the crane and a ground engaging position shown in FIG. 2 when the crane boom is to be operated, and will be referred to in greater detail hereinafter.

The crane also includes a superstructure 14 which is rotatably mounted about a vertical axis 15 on the upper portion of the tub 4 and is capable of rotating 360°. An extendible, telescoping boom 20 is pivotable about a horizontal shaft 22 at the upper end of the superstructure so that the boom can be vertically positioned about the horizontal axis 22. The boom is comprised of several telescoping sections so that its free end containing the boom point 24 (FIG. 1) can be extended many feet into the air. Certain essential elements of the crane are mounted on the superstructure such as the winch 30 and the power source E which may take the form of an internal combustion engine.

The boom itself may be of conventional construction and when fully extended it may reach a height of several hundred feet. The boom is vertically positioned by a large hydraulic cylinder 25 pivoted about a horizontal axis 26 to the superstructure and also pivoted at its forward end at 27 (FIG. 1) intermediate the length of the base section 28 of the boom. A load line 29 extends from the winch 30 over conventional pulleys on the boom point and it is connected to the load hook 31 in the known manner.

An operator's cab 32 is located on the front end of the main frame and in which the operator is located for driving the crane in the transport mode. Another operator's cab 33 containing appropriate controls, is located on the superstructure and is used for operating various components of the boom and crane when the crane is in the operating, boom operative mode.

The details of the construction of the main frame including the front portion 2, the rear portion 3, and the tub 4 are shown and described in the co-pending United States patent application Ser. No. 203,941, filed Nov. 7, 1980 and reference may be had to that application if a more complete description of the structure and advantages thereof are deemed to be either necessary or desirable.

OUTRIGGERS

The outriggers 10 and 11 are identical in construction and reference will be made to only one of them. As shown in FIG. 2, the outrigger 10 includes an outer generally hollow and elongated box 35 and a hollow elongated inner beam 36 telescopingly mounted within the box, both the box and the beam being of rectangular cross section and fabricated from steel plates which are welded together. The inner end of the box 35 is bifurcated into an upper part 37 and a lower part 38 (FIG. 2).

Power operated means 40 for swinging the outriggers horizontally are described in the co-pending United States patent application Ser. No. 203,944, filed Nov. 7, 1980 and reference may be had to that application if deemed to be necessary or desirable.

Figure 3:
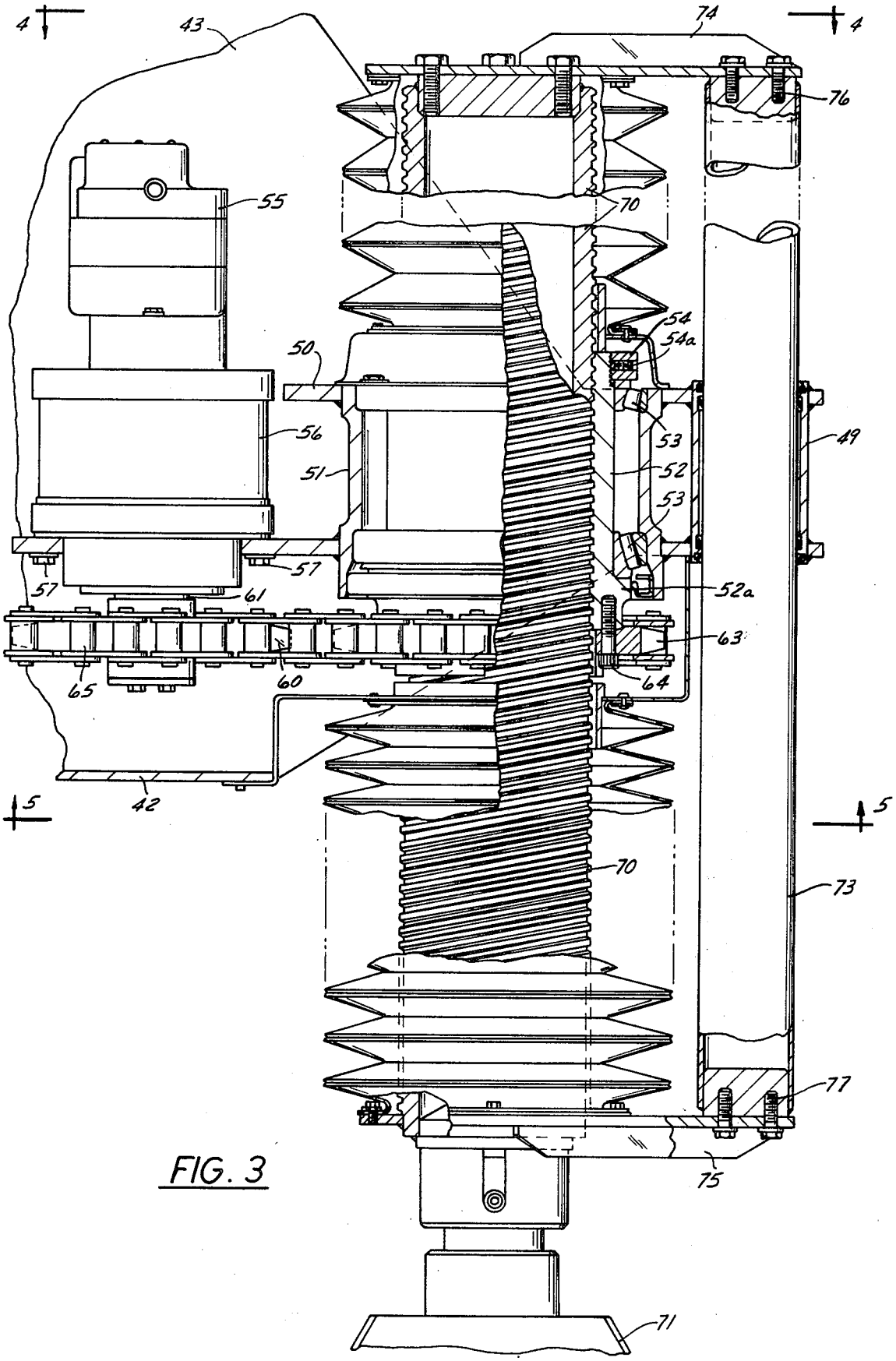
FIG. 3 is a vertical sectional view taken generally along the line 3—3 in FIG. 4, but on an enlarged scale with certain parts being broken away for clarity.
Figure 4:
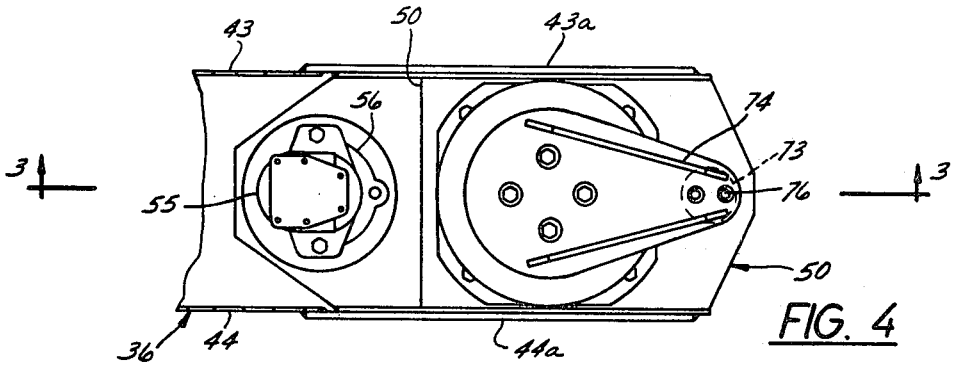
FIG. 4 is a plan view taken along line 4—4 in FIG. 3, but on a reduced scale, of the jackscrew and drive assembly.
Figure 5:
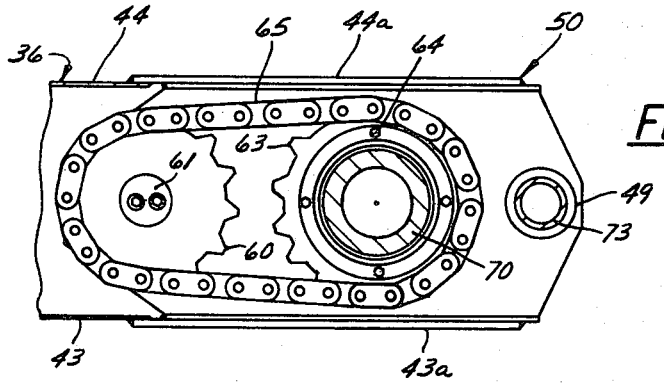
FIG. 5 is a sectional view taken along the line 5—5 in FIG. 3, but on a reduced scale, and showing the chain and sprockets.
Figure 6:
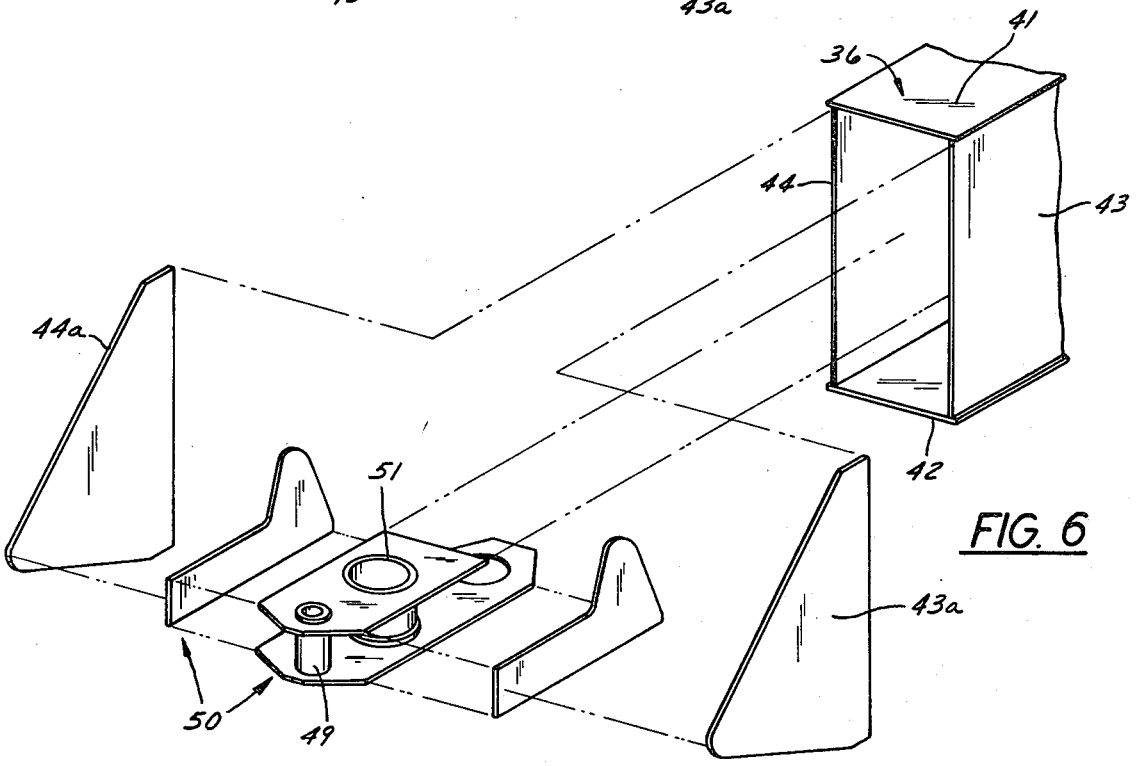
FIG. 6 is a perspective exploded view of the end portion of the outrigger and showing the mounting bracket, the view being enlarged from that shown in FIG. 2.

The outrigger beam 36 is formed by four steel plates welded together to form the upper side 41, lower side 42 and the two vertical sides 43 and 44. As shown in FIG. 3 and 6, a steel weldment bracket 50, including a tubular housing 51 and a sleeve 49, is welded between and to the tapered end 43*a* and 44*a* of side plates 43 and 44, respectively, of the beam.

A large nut 52 is rotationally mounted by anti-friction bearing assemblies 53 in the housing 51. The nut is disposed with its axis in a vertical direction and is held captive in the housing by its outwardly extending shoulder 52*a* and the locking ring 54 threadably engaged on the upper end of the nut and secured by two set screws 54*a* (one shown) to the upper end of the nut leaving the nut free to rotate relative to the beam.

Attached gear reducer 56 (FIG. 3) driven by the motor 55 is fixed by bolt means 57 to the frame 50 is located within the interior of the beam. A driver sprocket 60 is fixed to the downwardly extending shaft 61 of the gear reducer and is disposed in a horizontal direction. Another sprocket 63 is rigidly secured by cap screws 64 to the lower end of the large nut 53. An endless roller chain 65 is trained around both sprockets 60 and 63 to enable the reversible motor 55 to rotationally drive the large nut 52 in either direction.

A vertically disposed and tubular, externally threaded shaft 70 is in threadable engagement with the internally threaded nut and has a ground engaging pad 71 carried at its lower end. A torque bar 73 has an upper brace 74 and a lower brace 75 fixed to its upper and lower ends, respectively by the cap bolts 76 and 77. The torque bar 73 is carried by and vertically slideable in sleeve 49 carried at the outermost end of bracket 50. The upper brace 74 and the lower brace 75 are also fixed to the upper and lower ends of the threaded shaft 70, and thereby the torque bar 73 and its braces 74 and 75 prevent rotation of the threaded shaft 70, as the shaft 70 is vertically positioned by rotation of the nut 52.

With the present chain and sprocket assembly, not only an efficient driving means is provided for vertically positioning the jack because of the relative small friction loss, but furthermore there is no particular criticality involved in manufacturing the parts and there can be a certain amount of play between the parts and therefore distortion or misalignment of the parts does not cause malfunction of the vertical adjustment of the jack.

It should be noted that the jack (FIG. 1) is substantially flush with the top of the outrigger when it is in the crane stabilizing position and therefore interference with the load which may be swinging around the machine, or with other guy wires and apparatus around the machine is eliminated. Thus the load being handled by the crane can be swung around more freely and the likelihood of it striking the outrigger jack is minimized. The jack operating assembly including the motor, reduction gear sprockets, chain and the nut are located within the confines of the beam and are thus protected. The hollow nature of the threaded shaft 70 reduces weight and provides a good compressive member of high strength/weight ratio. The threaded member 70 has threads of a self-locking nature and therefore the jack is self-locking in any position to which it is driven.

We claim:

1. In a crane having an outrigger including an outer end disposed outwardly of the crane in a stabilizing position, a power operated, vertically positionable jack located at and fixed in a vertical attitude in the said outer end of said outrigger, said jack including a large nut stationarily mounted in said outer end but rotatably mounted in anti-friction bearings mounted in the outer end of said outrigger with the axis of said nut extending in a vertical direction, an elongated, tubular and externally threaded shaft threadably engaged in said nut and extending in and movable in a vertical direction, hydraulic motor power means located within and adjacent the outer end of said outrigger, a gear reducer connected to and driven by said motor, said nut and said power means mounted on a supporting bracket which is located within and secured to the outer end of said outrigger, a sprocket carried by an output shaft of said gear reducer of said power means and another sprocket fixed to said large nut, and an endless chain trained around both of said sprockets for providing driving power from said power means to said nut to rotate the latter, said power means being reversible, whereby said nut may be driven in either direction of rotation to cause said threaded shaft to rise and fall to any one of a number of selected vertical positions between a lower ground engaging, crane stabilizing position and an upper position free of the ground, the upper end of said threaded shaft when in the ground engaging position not extending appreciably above said outrigger, a torque bar carried by and at the end of said outrigger and which is vertically positionable with respect to said outrigger and connecting means between said torque bar and said threaded shaft to prevent rotation of the latter as said nut is rotated to thereby cause said threaded shaft to move in a vertical direction.

* * * * *